United States Patent [19]

Tyrell et al.

[11] Patent Number: 4,596,496

[45] Date of Patent: Jun. 24, 1986

[54] MINE ROOF SUPPORTING TRUSS SYSTEM

[75] Inventors: Gary D. Tyrell, Marietta, Ohio; Robert W. Hill, Whittington; Jerry Frease, Marion, both of Ill.

[73] Assignee: The Eastern Co., Naugatuck, Conn.

[21] Appl. No.: 643,042

[22] Filed: Aug. 22, 1984

Related U.S. Application Data

[63] Continuation-in-part of Ser. No. 537,083, Sep. 29, 1983, abandoned.

[51] Int. Cl.[4] ..... E21D 20/00

[52] U.S. Cl. ..... 405/288; 405/259

[58] Field of Search ..... 405/259, 288, 260, 261, 405/303

[56] References Cited

U.S. PATENT DOCUMENTS

| | | | |
|---|---|---|---|
| 3,427,811 | 2/1969 | White | 405/259 |
| 4,349,300 | 9/1982 | Kelly | 405/259 X |
| 4,395,161 | 7/1983 | Wilson et al. | 405/259 |
| 4,456,405 | 6/1984 | Galis | 405/259 X |

FOREIGN PATENT DOCUMENTS

| | | | |
|---|---|---|---|
| 2464399 | 4/1981 | France | 405/259 |
| 373421 | 6/1973 | U.S.S.R. | 405/259 |

*Primary Examiner*—Dennis L. Taylor

*Attorney, Agent, or Firm*—Charles S. McGuire

[57] ABSTRACT

A truss system is disclosed for use in supporting the roof of a mine. The system comprises an assemblage of elements which permit more rapid and efficient installation than prior art truss systems which have generally been installed as a secondary operation, after the standard, required bolting pattern is in place. The present system, on the other hand, may be installed concurrently with and in fact may become part of, the standard bolting system. The system includes a pair of roof bolts installed in conventional fashion in drill holes extending at divergent angles into the mine roof on opposite sides of the mine opening. The bolts each extend through aligned openings in a bearing support plate and a separate angle block having a curved outer surface. The closed ends of a U-bolt, having a curvature corresponding to the surface of the angle block, extend around the two blocks with the open, threaded ends of the U-bolts facing one another. A pair of blocks having three parallel openings therethrough are placed on the two U-bolts, the open ends thereof extending through the outer openings, and secured with nuts. A rod threaded at both ends, or a plurality of such rods joined by a threaded coupler, extends through the center opening of the block, thereby joining the two U-bolts, and is secured by nuts on each end. The truss is tensioned to a desired degree by threaded advance of the nuts on the U-bolts and/or coupling rods. The angle blocks are disclosed in two embodiments, the first having a planar surface engaged by the bolt head or a flat washer, and the second having an inwardly curved cavity surrounding the opening through which the bolt passes and is engaged by a mating washer on the bolt head. The design of the second embodiment permits considerable variation in the relative angular orientations of the truss elements.

14 Claims, 11 Drawing Figures

MINE ROOF SUPPORTING TRUSS SYSTEM

REFERENCE TO RELATED APPLICATION

This is a continuation-in-part of application Ser. No. 537,083, filed Sept. 29, 1983 of Gary D. Tyrell and Robert W. Hill, now abandoned.

BACKGROUND OF THE INVENTION

The present invention relates to mine roof support systems and, more specifically, to novel and improved mine roof supports employing truss systems with tensioned horizontal members.

The desireability of supporting mine roofs by means of horizontal members connected at their ends, and/or at intermediate points to anchoring members extending into drill holes formed for such purpose has long been recognized. Such systems are disclosed, for example, in 1925 U.S. Pat. No. 1,559,560 of Doughty and 1954 U.S. Pat. No. 2,667,037 of Thomas et al. It has further been recognized that added support capability is provided by additional tensioning of the horizontal member which connects the ends of the ends of the anchor members extending outside the holes, beyond the tension naturally resulting from installation of the anchor members at outwardly extending angles through the horizontal member. Such additional tensioning is shown, for example, in 1964 U.S. Pat. No. 3,163,012 of Dempsey, and 1969 and 1970 U.S. Pat. Nos. 3,427,811, 3,505,824, 3,504,726, all of White.

At the present state of commercial evolution of such truss systems, i.e., roof supports wherein a more or less horizontal member is tensioned between the lower ends of members anchored in upwardly extending drill holes, those presently in widest use, at least in this country, are used to supplement individually installed roof bolts. That is, as mining progresses into a seam, drill holes are formed in the roof at intervals prescribed by an approved roof support plan, and individual roof bolts are anchored within the hole and hold a bearing plate in contact with the area of the roof surrounding the openings. In a typical installation, for example, the roof bolts may be installed on four foot centers, resulting in a total of four bolts installed in a line laterally across a mine tunnel 20 feet in width.

In the present-day use of the truss systems referred to above, individual roof bolts are installed in the usual way as mining progresses to provide the necessary support in compliance with the approved roof plan. The truss system is usually installed at a later time, requiring the necessary machinery and personnel to be returned to the previously bolted area to install the truss system. The reason for this is the inordinately long time required to install the truss systems, unless additional machinery and personnel are employed, compared with the rate of advance of the mining operation. Even though sometimes justified by the increased safety provided by the added support capacity of the truss system, installation of such systems represents an enormous increase to the mining costs.

It is a principal object of the present invention to provide a truss system for mine roof support which can be installed as part of the regular mining cycle, i.e., an "in-cycle" truss system installation.

A further object is to provide a mine roof truss system wherein the anchoring members for the truss system provide part of the approved roof plan, replacing at least some of the individual anchor members in typical installations rather than being in addition thereto, thereby reducing the overall cost of the roof support system without any sacrifice in effectiveness.

Another object is to provide a mine roof support truss system having a greater range for tolerance of misalignment in both horizontal and vertical directions of the anchor members on each side of the truss without causing appreciable bending of the roof bolts, or causing appreciable movement of the roof plate used on the anchor members.

Still another object is to provide a truss system which may be tensioned more easily and at points removed from the center of the truss.

A still further object is to provide a truss system for mine roof support having a wide degree of latitude in the angles at which the drill holes for the anchor bolts may be formed.

Other objects will in part be obvious and will in part appear hereinafter.

SUMMARY OF THE INVENTION

In accordance with the foregoing objects, the invention contemplates a mine roof truss system which includes a pair of anchor members, such as threaded bolts or sections of rebar, installed in the mine roof in drill holes on opposite, but not necessarily directly opposed, sides of the tunnel, and secured by resin grouting and/or mechanical expansion anchors. The lower ends of the anchor members extend through openings in bearing support plates and in angle blocks, being secured on the lower side of the angle blocks by a head on the anchor member or a nut installed on a threaded end thereof, with a predetermined tension applied to the anchor members.

The anchor blocks have a first, essentially flat surface in contact with the lower surface of the support plates, and a second surface, surrounding the anchor block opening, for engagement by the anchor member head or a nut or washer installed thereon. In a first disclosed embodiment the second surface is in a flat plane, normal to the axis of the anchor member and thus at an angle, e.g., 45°, with respect to the first surface. In a second embodiment the second surface is formed by a substantially hemispherical recess surrounding the angle block opening and a mating, hemispherical washer is installed on the bolt head to permit variations in the angle at which the bolt is installed, i.e., the angle between the plane of the mine roof and the axis of the drill hole. The anchor blocks also have a curved surface extending in a semi-circle about an axis normal to the mine roof surface. A U-bolt, i.e., a U-shaped member with the free ends threaded, is placed around each angle block in mating engagement with the curved surface thereof, with the terminal ends of the U bolts directed toward one another. The legs of each of the U bolts are placed through the outer openings in blocks having a third opening located between the outer two, and secured with nuts threaded on the legs of the U bolts.

One end of an elongated rod, threaded for a predetermined distance from both ends, is placed through the center opening in one of the three hole blocks and secured with a nut. The other end of the same rod, or of another rod connected to the first by an internally threaded coupler, is placed through the center opening in the other block thereby connecting the two angle blocks by means of the U bolts, the three-hole blocks and elongated rod or coupled rods extending therebetween in close proximity to or contact with the mine roof. The nuts on the ends of the U bolts, and/or the nuts on the elongated rods are tightened to provide a tension in the horizontally extending members which is less than the aforementioned predetermined tension previously applied to the anchor members.

DETAILED DESCRIPTION

Figure 1:
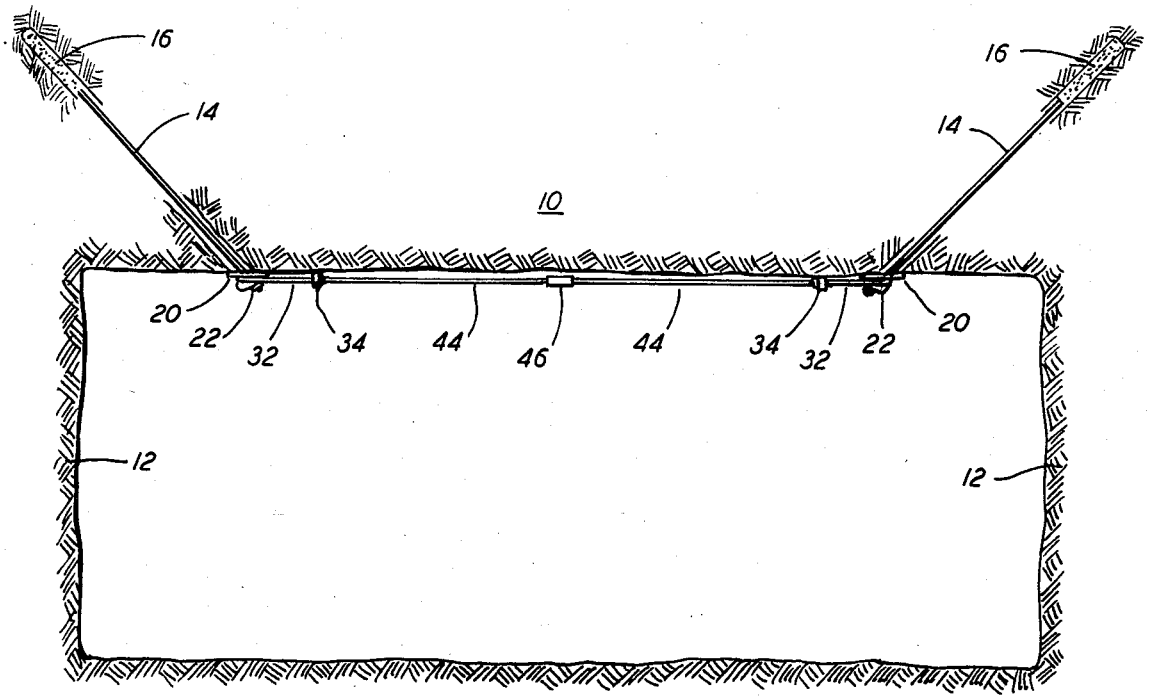
FIG. 1 is a front elevational view of the roof support truss system of the invention, fully installed in a mine roof which is shown in section.

Referring now to the drawings, in FIG. 1 is shown a cross section of a mine passageway or tunnel having overhead roof strata 10 and side walls or ribs 12. The present invention comprises means for reinforcing and supporting the roof strata and includes a pair of elongated rods 14 which are inserted in drill holes formed at approximately 45° angles to extend from open ends at the mine roof to upper, blind ends above ribs 12 on opposite sides of the passageway. The upper ends of rods 14 are firmly anchored in the drill holes by conventional means, such as expansion anchors or the illustrated resin grouting 16.

Rods 14 may comprise conventional roof bolts or lengths or so-called rebar having, in any case, means for tensioning the rods to a desired degree after installation. For example, the rods may conform to, and be installed in the manner of, those disclosed in application Ser. No. 310,546, filed Oct. 13, 1981 of Carl A. Clark, et al, assigned to applicants' assignee. Such rods are made of standard rebar having a threaded portion at the end extending outside the drill hole. A nut element, forming the subject matter of the aforementioned application, is threaded on the lower end of the rebar and serves as a means to effect rotation of the rebar, to break a resin cartridge and mix the contents, and to tension the rebar after the resin has set sufficiently to prevent rotation. Nut elements 18 provide these functions in the installation and tensioning of rods 14 in the roof support system of the present invention.

Figure 2:
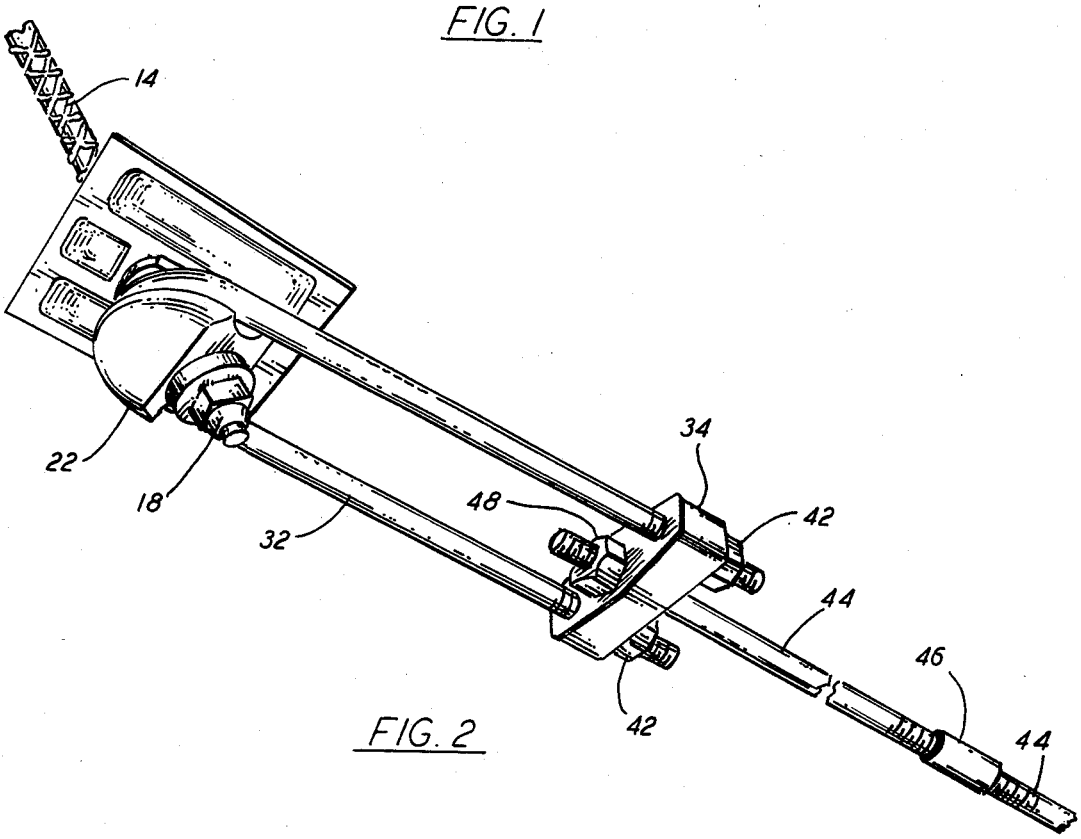
FIG. 2 is a perspective view of a portion of the truss system of FIG. 1.

The ends of rods 14 extending outside the drill holes are tied together by a tensioned horizontal structure which, together with the tensioned rods, forms a roof truss system. The truss system is seen in its entirety in FIG. 1, and in greater detail in the portion shown in perspective view in FIG. 2. A number of elements are duplicated on each side of the system, in addition to rods 14 and nuts 18, and being of identical construction are indicated by the same reference numerals.

The lower, threaded ends of rods 14 extend through openings in bearing support plates 20, preferably having the configuration of the plates disclosed in co-pending application Ser. No. 434,673, filed Oct. 15, 1982, of Lester L. Dye, and assigned to applicants' assignee. The rods also extend through openings in angle blocks 22, and nuts 18 are threaded on the rod ends with both plates 20 and angle blocks 22 between the nuts and the mine roof.

Figure 3:
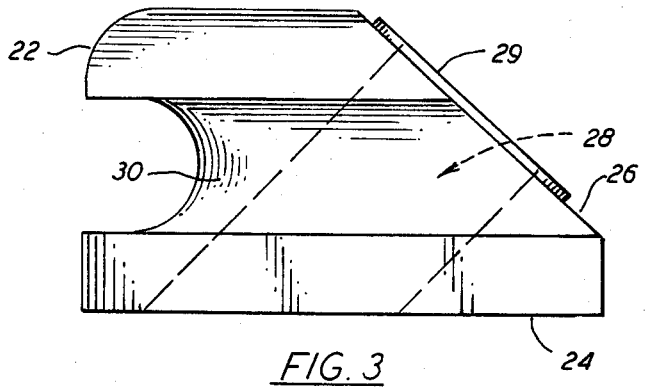
FIG. 3 is a side elevational view of a first embodiment of one of the elements of the truss system.
Figure 4:
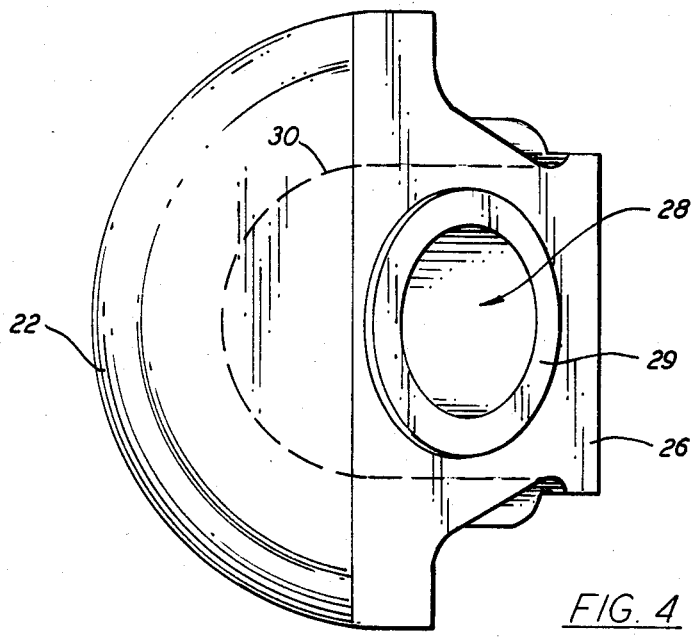
FIG. 4 is a top plan view of the element shown in FIG. 3.

Details of angle blocks 22 are more fully illustrated in FIGS. 3 and 4, and include a planar surface 24 which rests against a planar portion of the downwardly facing surface of plates 20 surrounding the central opening in the plate and between embossed areas thereon, which may be more clearly seen with reference to aforementioned application Ser. No. 434,673. A second planar surface 26 lies at an angle with respect to surface 24 approximately equal to the angle at which rods 14 are installed relative to the mine roof, i.e., about 45°. Opening 28 is surrounded on surface 26 by raised, annular area 29 and extends through block 22 along an axis normal to surface 26. Curved surface 30 extends symmetrically about an axis normal to surface 24, as seen in FIG. 4, and is also preferably curved or C-shaped in the vertical plane in the area of the bight of the curve, as seen in FIG. 3.

Figure 5:
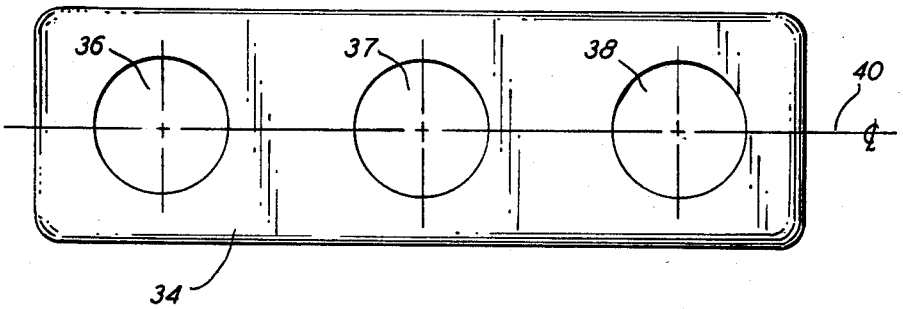
FIG. 5 is a front elevational view of another element of the system.

U-bolts 32, having a closed end with a radius of curvature substantially equal to that of surface 30, are threaded for several inches from each of the free ends. One of U-bolts 32 is placed around each of angle blocks 22 with the closed end of the bolts in contact with surfaces 30 of the blocks, whereby the free ends of the bolts are directed toward one another. Blocks or plates 34 are provided with three openings 36, 37 and 38, as seen in FIG. 5. The openings are of equal size and aligned on centers along axis 40. The two outer openings 36 and 38 are spaced to receive the free ends of U-bolts 32, which are inserted through the openings and secured by nuts 42.

The three-hole blocks 34 on the two U-bolts are joined by one or more elongated rods 44 which are threaded from both ends for portions of their lengths. Since the spacing between blocks 34 may vary from one installation to another, rods 42 are provided in several incremental lengths and, if a single rod of the greatest available length is not sufficient to span the distance between the blocks of a given installation, two or more such rods are coupled together to provide the required length. For example, in the installation shown in FIGS. 1 and 2, two rods 42 are joined by threaded engagement of one end of each with internally threaded coupling element 46. The other ends of the rods are inserted through center openings 37 in blocks 34 and secured by nuts 48.

Figure 8:
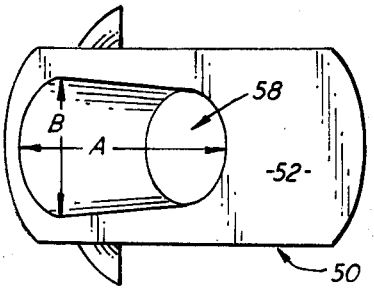

A second embodiment of the invention is shown in FIGS. 6–10, including a different configuration of the angle blocks, denoted by reference numeral 50. Angle blocks 50 have planar surface 52 for engagement with the bearing plate contacting the mine roof surface, and curved surface 54 around which the closed end of a U-bolt passes, as in the first disclosed embodiment. In the present construction, surface 56 which surrounds one end of opening 58, through which the anchor rod passes, is in the nature of a curved, essentially hemispherical, recess. Opening 58 is flared outwardly from the end at surface 56 to the end at planar surface 52, in directions both longitudinal and lateral of the blocks. That is, as shown in FIG. 8, opening 58 is considerably larger in the longitudinal direction (A) and is also larger in the lateral direction (B) at planar surface 52 than the diameter of opening 58 at concave surface 56, where the opening is circular.

Figure 9:
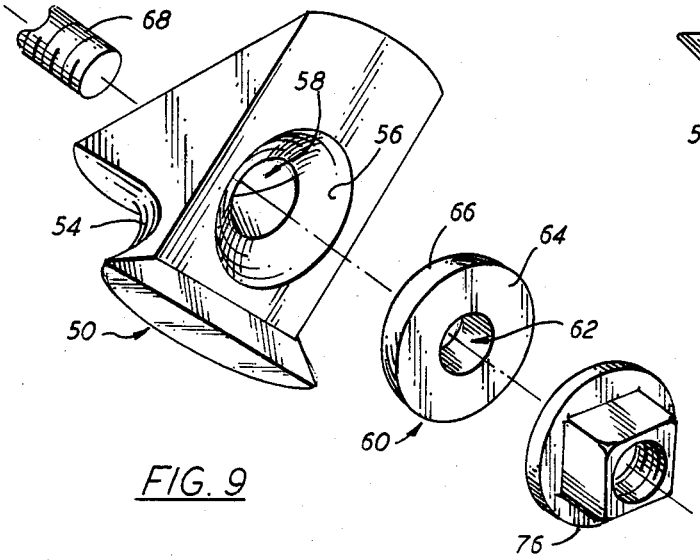
FIG. 9 is an exploded perspective view of a portion of a truss system incorporating the element of FIGS. 5–7.
Figure 6:
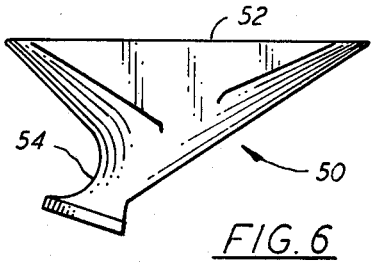
FIG. 6 is a side elevational view of a second embodiment of the element shown in FIGS. 3 and 4.

Angle blocks 50 are utilized in truss systems including washers such as shown in FIG. 9, denoted by reference numeral 60, having through opening 62, planar surface 64 and curved surface 66 for engaging surface 56 of the angle block. This is shown more clearly in FIG. 10 which illustrates a typical installation of this embodiment of the invention. Anchor rod 68 passes through opening 70 in roof support plate 72, opening 58 in angle block 50 and opening 62 in washer 60, being anchored at its upper end (not shown) within drill hole 74 by conventional mechanical and/or resin anchor means. Rod 68 may be tensioned by any of a number of conventional means, as in the previous embodiment, such as advancement of nut element 76 on the threaded lower end of rod 68 although equivalent means well known to those skilled in the art are available, depending upon the type of anchor means employed.

Figure 10:
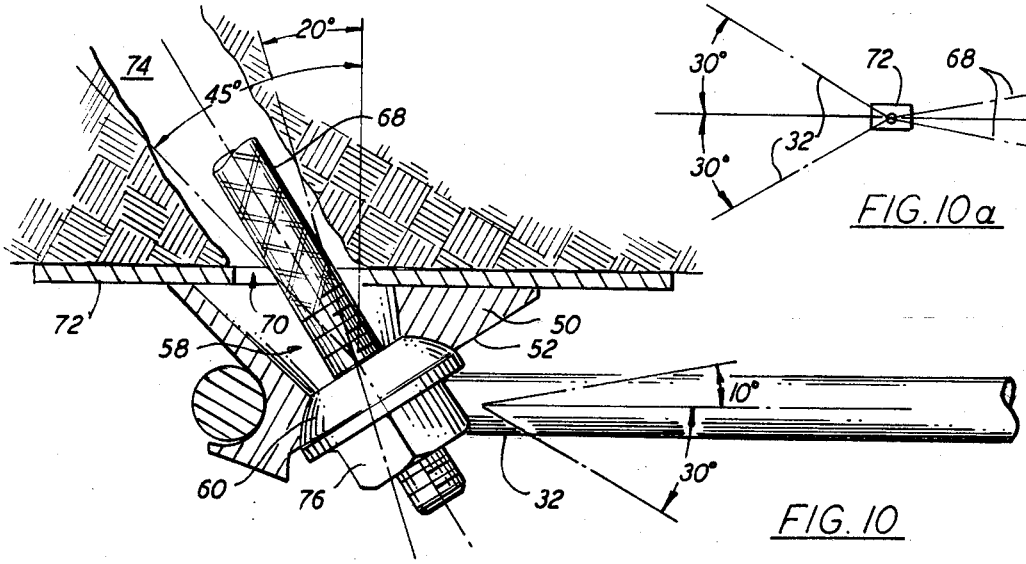
FIG. 10 is a side elevational view, in vertical section through the center, of a portion of an installed truss system incorporating the elements shown in FIG. 8.

The outward flare of opening 58 permits rod 68 to extend through anchor block 50 at any angle, within a range of limits, with respect to planar surface 52, and thus to the mine roof. Since surfaces 56 and 66 of angle block 50 and washer 60, respectively, are curved complementary to one another in essentially hemispherical form, close engagement will be maintained throughout the range of angles at which rod 68 may extend through block 50. The convex surface which mates with concave surface 56 surrounding anchor block opening 58 may be formed as part of, i.e., integrally with, the outer end of the anchor rod, rather than being in the form of a separate washer element. This provides the very advantageous feature of allowing the drill holes to be formed at any angle with respect to the plane of the mine roof within the range of angles at which rod 68 may extend with respect to surface 52. The three-hole blocks, and horizontal tensioning members are not illustrated in FIG. 10, being the same as in the previously described embodiment, as are U-bolts 32, a portion of one of which is shown in FIG. 10 engaging surface 54 of angle block 50.

The particular range of values of the angles at which the anchor rods may be installed may be varied as desired, within practical limits, by selection of the various dimensions, angles, etc. of the angle blocks. In a preferred embodiment, opening 58 is flared outwardly from surface 56 to surface 52 to accommodate rod installation angles over a range of 20° to 45° from a line perpendicular to surface 52. That is, for installations where the mine roof is horizontal, as in FIG. 10, rods may be installed in holes drilled at angles of anywhere between 20° and 45° from the vertical, as indicated in FIG. 10. In addition, the rods may be installed at lateral angles of up to 10° on either side of the longitudinal centerline of the truss, i.e., a line extending along the axis of the horizontal connecting members, as shown diagrammatically in FIG. 10*a*.

Figure 10A:
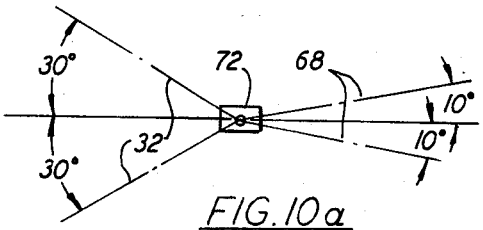
FIG. 10*a* is a diagrammatic plan view of the installation of FIG. 10.
Figure 7:
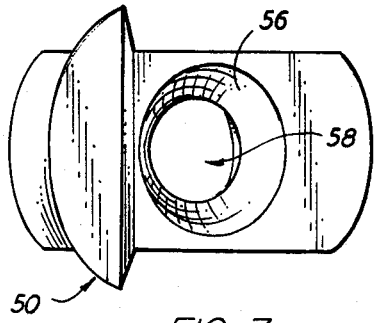
FIGS. 7 and 8 are top and bottom plan views, respectively, of the element of FIG. 6.

Design of angle blocks 50 also accommodates variations in both the horizontal and vertical positions of the rod-plate-angle block installations on opposite sides of the truss. For example, in the illustrated design, the U-bolts may extend upwardly at up to 10° and downwardly at up to 30° from the horizontal, i.e., to a line parallel to the adjacent portion of the mine roof, as indicated in FIG. 10. Also, the angle blocks 50 are designed to permit variations of up to 30° on either side in the horizontal direction of the centerlines of the U-bolts, as indicated in FIG. 10*a*. Thus, the present embodiment of the invention provides considerable latitude in the positions and angles at which the various truss elements may be installed, thereby permitting use in widely varying types and contours of mine roofs.

From the foregoing, it may be seen that the truss system of the present invention provides the desired roof support function, supplementing that of the usual, individual roof bolts, while remaining relatively simple and inexpensive to manufacture. Also, and of at least equal importance, is the fact that the components may be assembled at the point of use and installed quite easily and rapidly, especially as compared to commercially available truss systems currently in use. As mentioned earlier, this not only represents a large savings in labor costs connected with truss installation, but also permits installation of the system as part of the normal mining cycle. That is, the truss system may be installed quickly enough to keep pace with the normal roof support operation.

Referring again to FIG. 1, a mine tunnel or passageway approximately 20 feet in width would typically require support at four points by roof bolts installed at spaced points across the width of the roof at each bolting interval along its length. Current commercial roof truss systems are typically not installed as the mining cycle progresses due to the amount of time required for truss installation. Consequently, in order to allow the mining operation to progress at its normal pace, a complete system of four roof bolts would be installed across the mine roof at each bolting interval, and the truss system, with its two additional anchor members, would be installed at a later time. In the present system, two conventional roof bolts or tensioned rebars (not shown) would be installed at approximately equally spaced intervals between the two anchor members 14 forming part of the truss system. However, since the truss system is installed in the mining cycle there is no requirement for the installation of two additional bolts in the same general location as members 14, thereby saving the cost of such additional bolts and associated installation costs. This would apply, of course, with both of the disclosed embodiments of the angle blocks.

The present truss system is installed by anchoring the two rebars in a resin grouting in previously formed drill holes in the usual manner. The lower ends of the rebars extend outside the drill holes, through openings in support plates and angle blocks, which are secured by nuts on the threaded, lower ends of the rebars. The nuts are tightened by conventional wrench means to apply a desired degree of tension to the rebar. Recommended levels are about 12,000 lbs. tension for No. 6 rebar, by applying approximately 200 ft-lbs. torque, and 15,000 to 18,000 lbs tension for No. 7 rebar, by applying 250–300 ft-lbs torque. These torque ranges may be higher or lower, depending on roof bolting practises at the particular mining location.

After installation and tensioning of the anchor members, with the support plates and angle blocks in place, the horizontal portion of the truss system is installed. When the two U-bolts and connecting rods have been assembled with the 3-hole blocks and supported by engagement of the U-bolts around the angle blocks, these members are tensioned by tightening nuts 42 on the ends of the U-bolts, and/or nuts 48 on the ends of the connecting rods with manual or power-driven wrenches. Sufficient clearance is provided between the legs of the U-bolts for a hydraulic wrench to tighten nuts 48. The recommended degree of tension applied to the horizontal portion of the truss system is in the range of 10% to 70% of the tension applied to the anchor members, depending on the characteristics of the mine roof being supported. For example, the horizontal connecting members are preferably tensioned to about 7,000 lbs by application of approximately 115 ft-lbs of torque to the nuts.

The horizontal connecting members obviously are very close to the mine roof, maximizing clearance, and are tensioned from positions near the sides of the mine passage, thus minimizing interference with movement of equipment and personnel therethrough. Although the angle blocks are specially fabricated for use in the present truss system, they are separate and distinct from the support plates, thereby permitting the use of standard plates already in commercial circulation. Also, the connection of the lower ends of the anchor members with the use of U-bolts passing around a curved surface of the angle blocks provides a higher tolerance for misalignment of the positions of the lower ends of the anchor member. While the legs of the U-bolts will normally be parallel, as shown, it is of course possible to provide the truss system with U-bolts having non-parallel legs. It is further noted that, rather than having threaded ends extending through openings in the three-hole blocks, the legs of the U-bolts may have integral heads and be inserted into slots in the blocks. It is again emphasized that the embodiment of FIGS. 6–10 permits variation not only in the angles at which the anchor members and U-bolts may be installed, but also allows considerable latitude in the positions of the two anchor members which are installed on opposite sides of the mine passageway. That is, the design tolerance of 30° in either direction in the horizontal plane of the centerline of the U-bolts allows the anchor members to be installed at different locations along the passageway, and the description of the anchor member installation as being on opposite sides of the passageway is not to be construed as limited to directly opposite.

What is claimed is:

1. A truss-type support system for the roof of a mine passageway comprising:

(a) a pair of anchor members in the form of first and second elongated rods installed in drill holes formed in the roof on opposite sides of the passageway, one end of said anchor members being permanently anchored in the drill holes and the other end extending outside the holes;

(b) a pair of support plates each having an opening through which a respective one of said other ends of said anchor members passes;

(c) a pair of blocks structurally separate from said plates, said blocks each having an opening through which a respective one of said other ends of said anchor members passes with said plates between said blocks and the mine roof;

(d) each of said blocks further including a curved surface extending for approximately 180 degrees about an axis passing through said opening therein substantially normal to the mine roof;

(e) means on said other ends of said anchor members for maintaining said blocks in forceful engagement with said plates, and said plates in forceful engagement with the mine roof in the area surrounding said drill holes;

(f) a pair of U-bolts having closed ends extending around said curved surfaces of said blocks to free ends directed toward one another;

(g) means connecting said free ends of said U-bolts; and (h) first and second tensioning means for applying a desired degree of tension to said anchor members and said U-bolts, respectively, said second tensioning means being positioned at and accessible from a location substantially laterally of the center of said mine passageway.

2. The invention according to claim 1 wherein said anchor members are threaded from said other ends thereof for a portion of their length, and said means on said other ends comprise nut elements threaded on said other ends.

3. The invention according to claim 1 wherein said drill holes are formed along divergent axes at a predetermined angle to the mine roof adjacent opposite sides of the passageway with said one end of each of said anchor members being anchored at a position laterally of the sides of the passageway, above the side walls thereof.

4. The invention according to claim 1 wherein the tension applied to said connecting means is less than that applied to said anchor members in the fully installed condition of said support system.

5. The invention according to claim 4 wherein the tension applied to said connecting means is not greater than about 70% of the installed tension applied to said anchor members.

6. The invention according to claim 4 wherein said blocks each include a first planar surface contacting a respective one of said plates, and a second planar surface normal to the axis of said openings, which extend through said blocks between said first and second planar surfaces.

7. The invention according to claim 6 wherein said first planar surface is at an angle of about 45% to said second planar surface.

8. The invention according to claim 1 wherein said connecting means comprises a third elongated rod connected at its opposite ends to the free ends of said U-bolts.

9. The invention according to claim 8 wherein said third rod and said U-bolts are each threaded from said free ends thereof for a portion of their lengths, and said connecting means further includes a pair of members each having three openings through which said threaded portions of said free ends of one of said U-bolts and one of said third rod ends pass.

10. The invention according to claim 9 wherein nuts are placed on said threaded portions of each of said U-bolts free ends and third rod ends to effect engagement with said members, and said connecting means are tensioned by tightening at least one of said nuts.

11. The invention according to claim 4 wherein said blocks each include a planar surface surrounding one end of said opening and a concave, substantially hemispherical surface surrounding the other end, and wherein said means on said other ends of said anchor members comprise means defining a convex surface in mating engagement with said concave surface of said blocks.

12. The invention according to claim 11 wherein said block openings are flared outwardly from said other end toward said one end to permit said anchor members to extend through said openings along an axis at any desired angle, within a predetermined range of angles, with respect to said planar surface of said blocks.

13. The invention according to claim 12 wherein said block openings are flared outwardly in two directions, longitudinally and laterally of said blocks, to permit said anchor members to extend along an axis at any desired angle, within a predetermined range of angles, in either of said two directions with respect to said planar surface of said blocks.

14. The invention according to claim 13 wherein said means defining a convex surface comprises a washer element having a central opening through which said rod extends.

* * * * *